US010907530B2

(12) United States Patent
Cierpial et al.

(10) Patent No.: US 10,907,530 B2
(45) Date of Patent: Feb. 2, 2021

(54) WATER JACKET DIVERTER AND METHOD FOR OPERATION OF AN ENGINE COOLING SYSTEM

(71) Applicant: Ford Global Technologies, LLC, Dearborn, MI (US)

(72) Inventors: Philip Damian Cierpial, Grosse Pointe Park, MI (US); Paul Shoemaker, Dearborn, MI (US); Donna O'Hara, Dearborn, MI (US); James Schneider, Royal Oak, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/409,606

(22) Filed: May 10, 2019

(65) Prior Publication Data

US 2020/0355109 A1 Nov. 12, 2020

(51) Int. Cl.

| | |
|---|---|
| ***F01P 5/10*** | (2006.01) |
| ***F01P 7/14*** | (2006.01) |
| ***F02F 1/16*** | (2006.01) |
| ***F01P 3/02*** | (2006.01) |

(52) U.S. Cl.

CPC ..... *F01P 7/14* (2013.01); *F01P 3/02* (2013.01); *F02F 1/16* (2013.01); *F01P 2003/021* (2013.01)

(58) Field of Classification Search

CPC ..... F01P 7/14; F01P 3/02; F01P 2003/021; F02F 1/16

USPC ..... 123/41.44

See application file for complete search history.

(56) References Cited

U.S. PATENT DOCUMENTS

| | | | | |
|---|---|---|---|---|
| 8,474,418 | B2 * | 7/2013 | Shikida | F01P 3/02 123/41.74 |
| 9,624,816 | B2 * | 4/2017 | Matsumoto | F01P 5/10 |
| 2005/0217614 | A1 | 10/2005 | Matsutani et al. | |
| 2005/0235930 | A1 * | 10/2005 | Xin | F02F 1/108 123/41.74 |
| 2009/0194046 | A1 * | 8/2009 | Shikida | F02F 1/14 123/41.74 |
| 2009/0266315 | A1 * | 10/2009 | Hanai | F02F 1/14 123/41.72 |
| 2011/0114040 | A1 * | 5/2011 | Hashimoto | F02F 1/14 123/41.72 |
| 2011/0114041 | A1 * | 5/2011 | Hamakawa | F02F 1/14 123/41.72 |

(Continued)

FOREIGN PATENT DOCUMENTS

DE 102009034639 A1 2/2010

OTHER PUBLICATIONS

Cierpial, P., "Flow-Directing Water Jacket Diverter," U.S. Appl. No. 16/019,100, filed Jun. 26, 2018, 48 pages.

*Primary Examiner* — Long T Tran
*Assistant Examiner* — James J Kim
(74) *Attorney, Agent, or Firm* — Geoffrey Brumbaugh; McCoy Russell LLP

(57) ABSTRACT

Methods and systems are provided for a water jacket diverter. In one example, a water jacket diverter for a cylinder block is provided that includes a masking wall arranged above a rail and including a tuning section having a reduced thickness when compared to a remainder of the masking wall. The water jacket diverter also includes a tuning ledge adjacent to the masking wall and extending outward from the masking wall with regard to a cylinder bore axis.

14 Claims, 9 Drawing Sheets

(56) References Cited

U.S. PATENT DOCUMENTS

| | | | | |
|---|---|---|---|---|
| 2011/0132295 | A1* | 6/2011 | Hamakawa | F02F 1/14 123/41.74 |
| 2012/0204821 | A1* | 8/2012 | Tofukuji | F02F 1/14 123/41.79 |
| 2015/0345363 | A1* | 12/2015 | Marutani | F02F 1/166 123/41.44 |
| 2015/0377114 | A1* | 12/2015 | Matsumoto | F02F 1/14 123/41.44 |
| 2016/0115854 | A1 | 4/2016 | Clever et al. | |
| 2016/0195000 | A1* | 7/2016 | Nakashima | F01P 3/02 123/41.74 |
| 2017/0022929 | A1* | 1/2017 | Karita | F01P 3/02 |
| 2017/0167354 | A1* | 6/2017 | Park | F02F 1/14 |
| 2017/0175611 | A1* | 6/2017 | Wakamoto | F01P 3/02 |
| 2017/0298860 | A1* | 10/2017 | Mori | F01P 3/02 |
| 2017/0306833 | A1* | 10/2017 | Yang | F01P 3/02 |
| 2017/0350302 | A1* | 12/2017 | Araki | F02F 1/14 |
| 2018/0313250 | A1* | 11/2018 | Nakayama | F02F 1/14 |
| 2018/0355780 | A1* | 12/2018 | Fujita | F02F 1/14 |
| 2019/0390629 | A1* | 12/2019 | Cierpial | F02F 1/40 |

* cited by examiner

WATER JACKET DIVERTER AND METHOD FOR OPERATION OF AN ENGINE COOLING SYSTEM

FIELD

The present description relates generally to a system for cooling an engine block.

BACKGROUND/SUMMARY

Large quantities of heat may be generated during combustion of air and fuel within cylinders of an engine during engine operation. Absorption of the heat may result in a temperature of a cylinder block rising to an extent where cylinder components, such as intake and exhaust valves, pistons, a cylinder bore, etc., may become degraded, particularly upon repeated exposure to the combustion heat. Heat absorption at the cylinders also increases the likelihood of engine knock and decreases engine performance, thereby reducing fuel economy. The issues associated with excessive heating of the cylinders are typically mitigated via cooling systems. In the cooling system the cylinder block may be cooled via a water jacket. The water jacket typically includes coolant cavities in the cylinder block surrounding the cylinders.

More recently, plastic injection-molded water jacket inserts have been used to redirect coolant flow in water jackets in an attempt augment coolant flow in the water jacket. One example approach is shown by Clever et al. in US 2016/0115854 A1, teaching a system with a water jacket insert. However, the inventors have recognized several issues with Clever's cooling system. For instance, the cooling system may have unwanted temperature gradients across the water jacket, leading to uneven cylinder cooling. In particular, the insert in the cooling system increases coolant velocity in the upper portion of the water jacket, causing piston scuff which reduces engine durability. The inventors have also recognized that the problem of piston scuff is exacerbated when the elevated coolant flow velocities are localized on the major piston thrust side of the block.

In one example, the issues described above may be addressed by a water jacket diverter for a cylinder block. The water jacket diverter includes a masking wall arranged above a rail and including a tuning section having a reduced thickness when compared to a remainder of the masking wall. The water jacket diverter also includes a tuning ledge adjacent to the masking wall. The tuning ledge extends outward from the masking wall with regard to a cylinder bore axis. The masking wall and the tuning ledge allow flow patterns in the water jacket to be tuned to reduce cooling inconsistencies in the cylinder block. More balanced cylinder block cooling can therefore be achieved, leading to an increase in engine durability. For instance, the amount of piston scuff may be reduced (e.g., eliminated) when a masking wall and a tuning ledge are included in the water jacket diverter due to the flow pattern generated by the wall and ledge. In particular, the flow pattern may cause more balanced cooling of the cylinder block with regard to its major and minor thrust sides.

In one example, the masking wall is positioned adjacent to a major thrust side of a cylinder bore in the cylinder block. In this way, coolant flow may be decreased on the major thrust side of the cylinder bore to the balancing of coolant flow on the major thrust side and the opposing minor-thrust side. As a result, piston scuff caused by cylinder block warping is reduced, thereby increasing engine longevity.

In another example, an inlet of a cylinder block water jacket opens into a section of the cylinder block water jacket adjacent to the masking wall. In this way, inlet coolant flow impinges upon the wall to locally reduce the velocity of coolant flow. Consequently, a desired flow pattern in the water jacket can be generated that reduces temperature gradients in the cylinder block. As a result, the chance of unwanted thermal deformation of the block is reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-11 are shown approximately to scale. However, other relative dimensions may be used, in other embodiments.

DETAILED DESCRIPTION

The following description relates to a diverter for a water jacket in a cylinder block. The contour of the flow diverter generates a coolant flow pattern in the water jacket that more evenly cools the block by decreasing coolant velocities in localized high flow regions of the jacket. Consequently, temperature gradients in the water jacket can be reduced, to decrease the likelihood of thermal deformation of the cylinder block. The structural features of the diverter facilitating the coolant flow balance functionality include a masking wall extending upwards (e.g., axially upwards) from a rail. The diverter also includes a tuning ledge extending outward (e.g., radially extending outward) from the masking wall. In one example, the ledge may curve in a downward direction while the masking wall extends in an upward direction. In this way, the coolant flow may be tuned to moderate cooling imbalances in the cylinder block, such as vertical imbalances and lateral imbalances, for instance. In one example, the masking wall may be positioned on a major thrust side of the cylinder bore. In this way, disproportionate cooling of major and minor thrust sides of the cylinder block is decreased. Specifically, the masking wall reduces coolant flow velocities around the major thrust side, to balance block cooling. Consequently, a reduction in thermal deformation of the block causing unwanted engine behaviors (e.g., piston scuff) is achieved.

Figure 1:
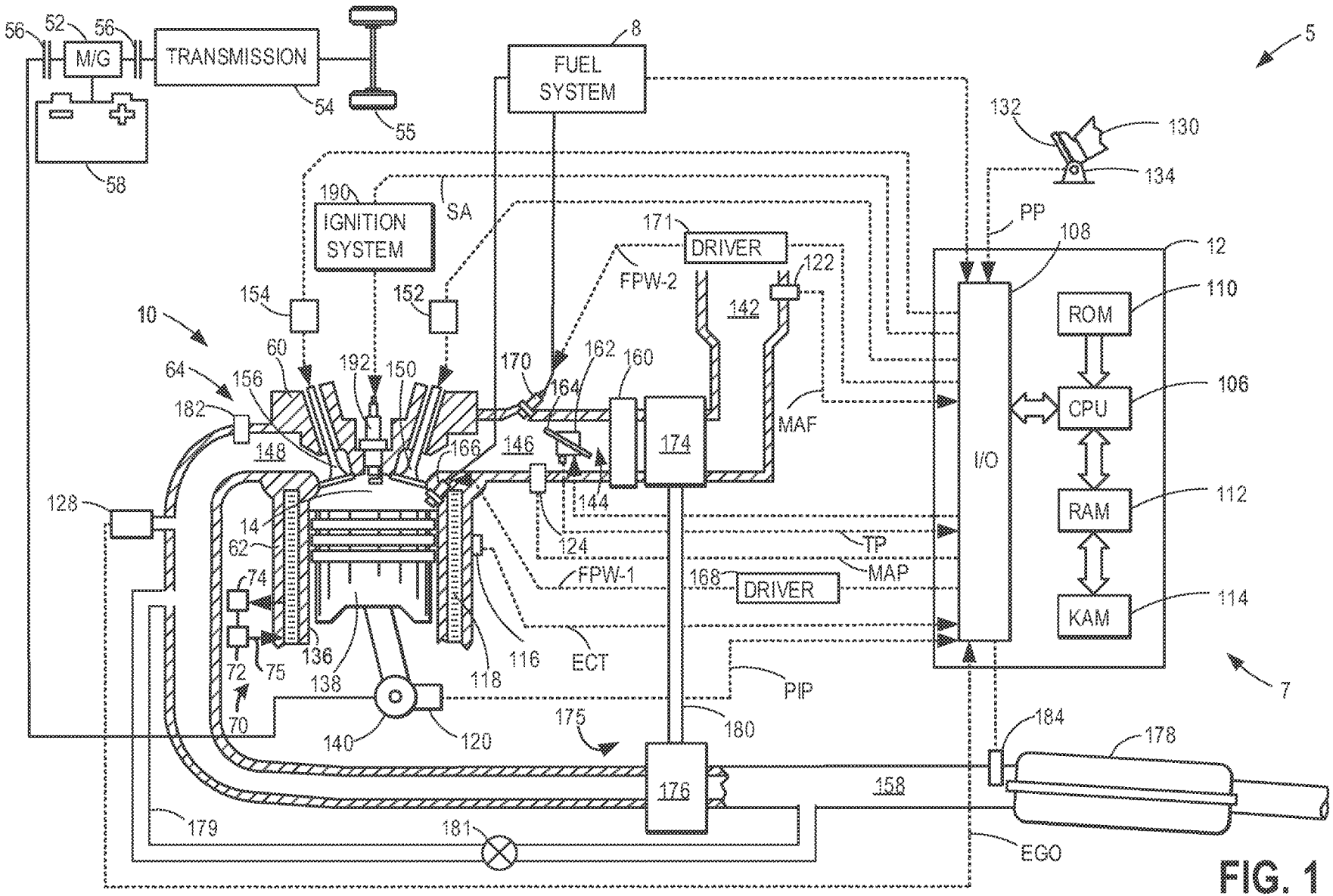
FIG. 1 shows an example engine system that may be adapted with a diverter positioned in a water jacket of a cylinder block.
Figure 2:
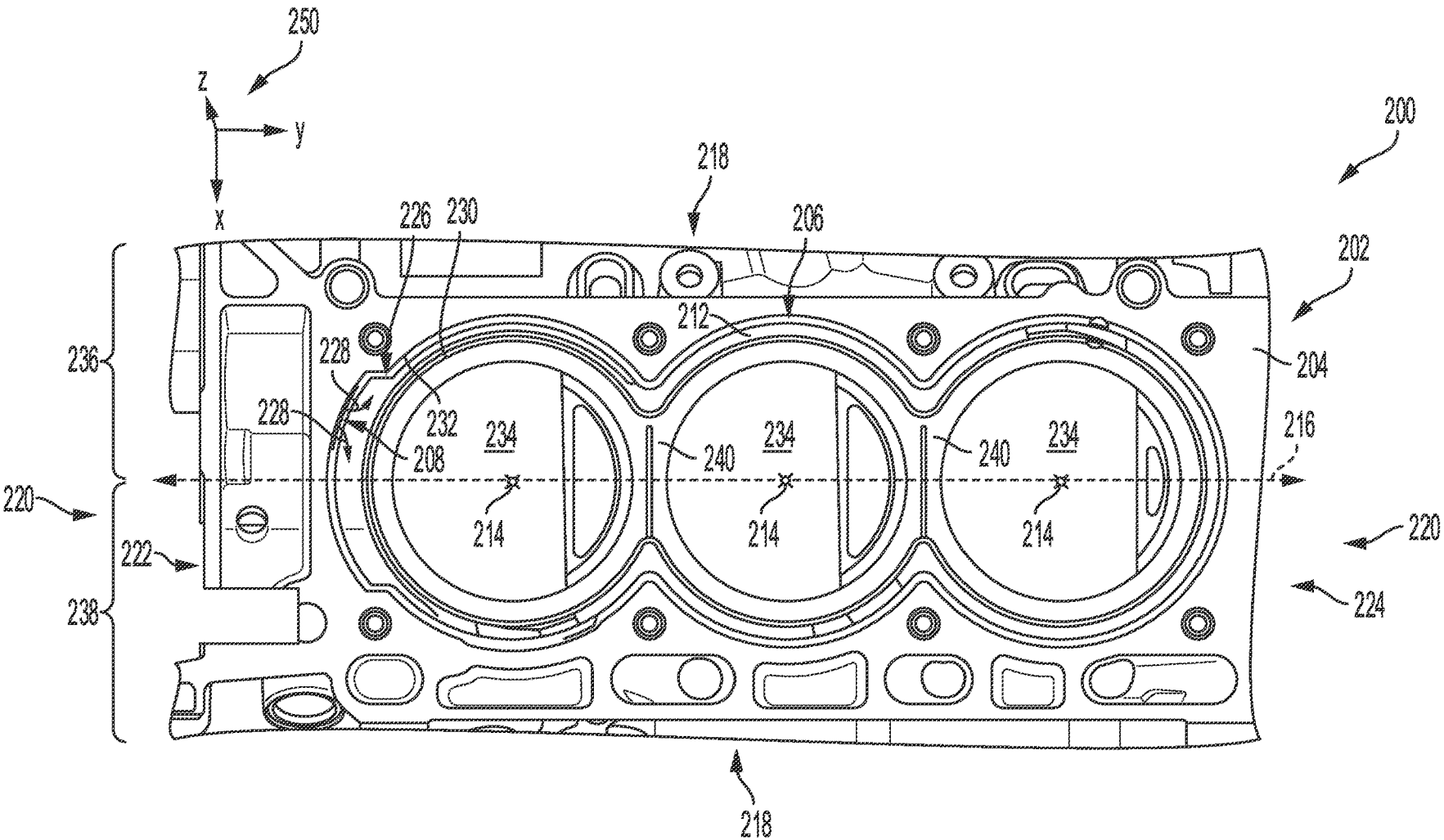
FIG. 2 shows an engine system with a first example of a water jacket diverter.
Figure 8:
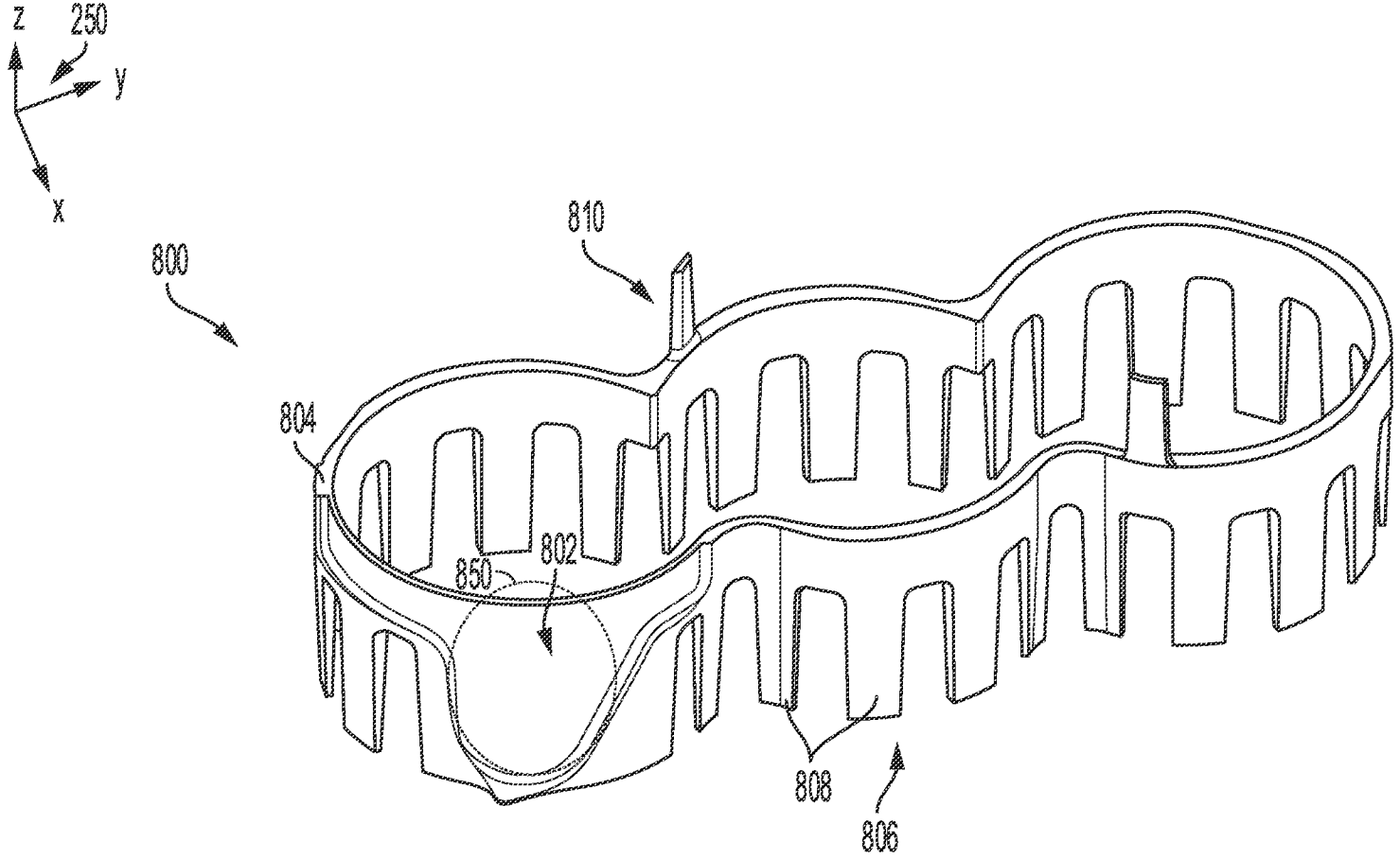
FIG. 8 shows a second example of a water jacket diverter including a masking wall.
Figure 9:
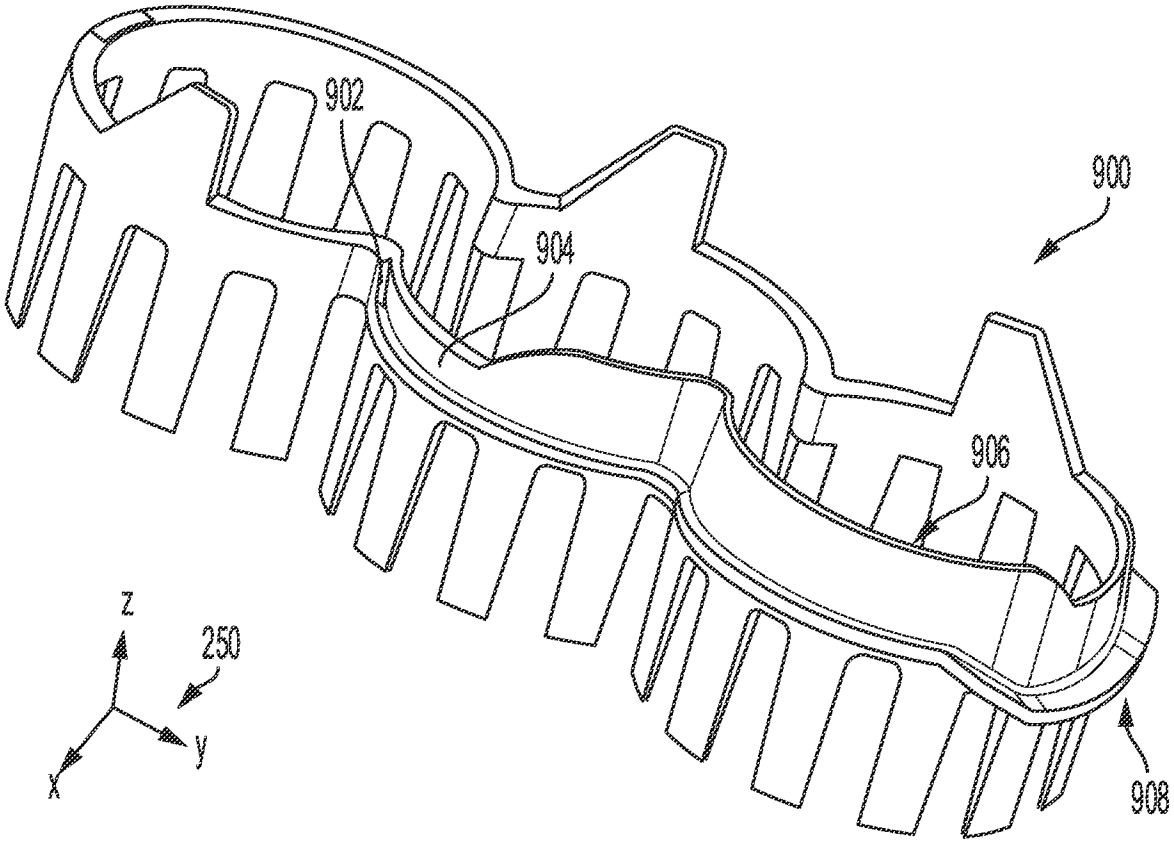
FIG. 9 shows a third example of a water jacket diverter with a cut-out in a rail.
Figure 11:
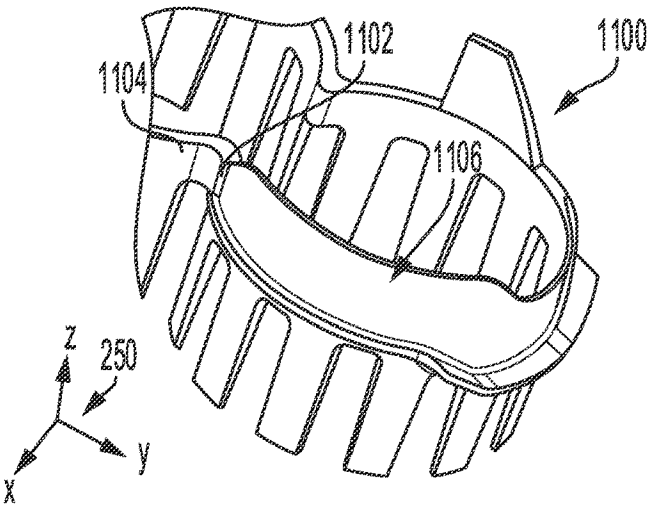
FIG. 11 shows a fifth example of a water jacket diverter with a cut-out in another location in a rail.
Figure 10:
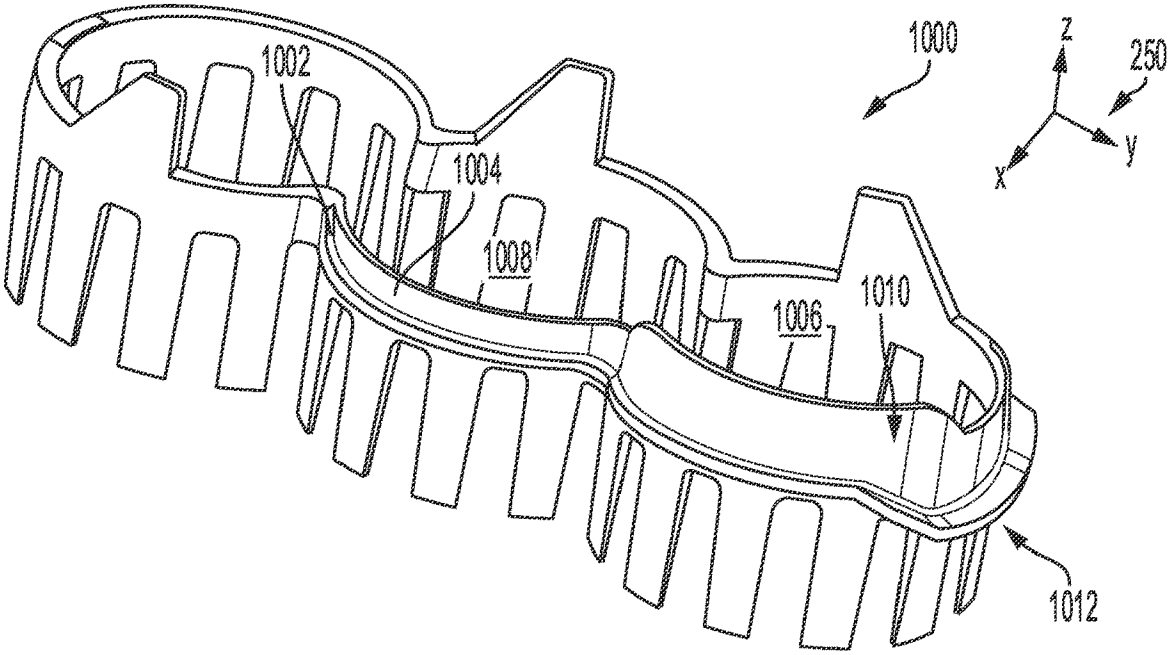
FIG. 10 shows a fourth example of a water jacket diverter with a masking wall and a cut-out in a rail.
Figure 12:
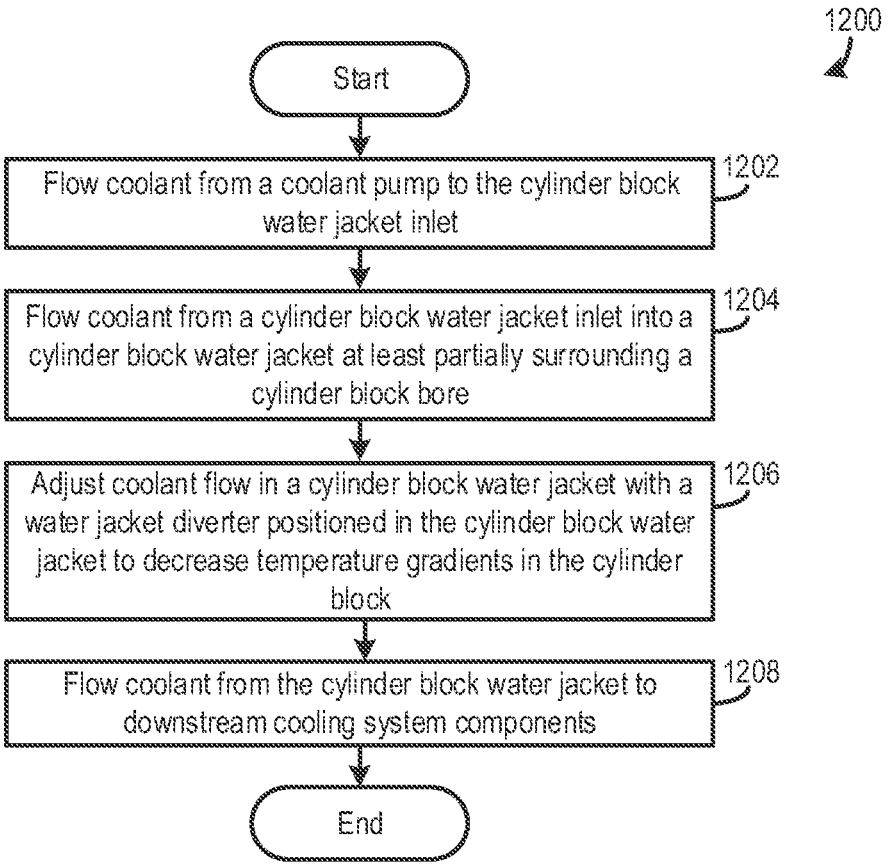
FIG. 12 shows a method for operation of an engine cooling system.

FIG. 1 shows a schematic depiction of an engine including a cooling system. FIG. 2 shows a perspective view of a first example of an engine block including a water jacket and flow diverter generating a desired coolant flow pattern in the jacket. FIGS. 3-7 show other views of the first example the water jacket diverter, depicted in FIG. 2. FIG. 8 illustrates a perspective view of a second example of a water jacket diverter. FIG. 9 shows a perspective view of a third example of a water jacket diverter. FIG. 10 shows a perspective view of a fourth example of a water jacket diverter including a cut-out in a rail for additional flow tuning. FIG. 11 shows a fifth example of a water jacket diverter with a rail cut-out. FIG. 12 shows a method for operating an engine cooling system.

An example of an engine 10 including a water jacket 118 designed to cool a cylinder 14 is shown in FIG. 1. The engine 10 comprises an engine system 7 and is included in vehicle 5. The engine 10 also includes a cylinder head 60 coupled to a cylinder block 62 forming the cylinder 14. It will be appreciated that the portion of the cylinder 14 included in the cylinder block may be referred to as a cylinder block bore. The cylinder block 62, a water jacket 118, and/or flow diverter (now shown) may be included in an engine block 64.

The cylinder 14 (which may be referred to herein as a combustion chamber) of engine 10 may include combustion chamber walls 136 with piston 138 positioned therein. The water jacket 118 may form a cavity within the chamber walls 136 and circumferentially surround cylinder 14. A coolant, such as water and/or an aqueous solution of ethylene glycol, may be flowed through water jacket 118 to extract heat from the piston 138 and the chamber walls 136. Therefore, it will be understood that a variety of suitable coolants other than purely water may be used as the working fluid in the cooling system, if desired. Water jacket 118 may include an insert (not shown), or diverter, such as the embodiments of a diverter shown in FIGS. 3-7 to modify a path of coolant flow through the water jacket 118. The water jacket 118 is included in an engine cooling system 70 designed to circulate coolant through the water jacket 118 and draw heat away from the engine 10. The engine cooling system 70 further includes a coolant pump 72 and a heat exchanger 74 (e.g., radiator). Arrows 75 depict the general direction of coolant flow through the engine cooling system 70. The coolant pump 72 is designed to drive coolant circulation through coolant system conduits, the water jacket, etc. Thus, the pump may include piston(s), seal(s), chamber(s), vane(s), rotor(s), etc., to achieve the pumping functionality. The heat exchanger 74 may include conduits, chambers, heat sinks (e.g., fins), etc., allowing for the transfer of heat away from the cooling system such as to the ambient environment, another coolant loop, etc. Although the engine cooling system 70 is shown including just a cylinder block water jacket, it will be appreciated that the cylinder head may additionally include a water j acket, in another example. In such an example, coolant may flow between the cylinder block and the cylinder head water jackets, in parallel or series flow configurations, for instance. However, in other examples, each water jacket may have a dedicated coolant loop or the water jackets may be designed with a more complex flow pattern having both series and parallel coolant flow arrangements. More generally, the cooling system 70 may have additional complexity that is not illustrated in FIG. 1, such as additional coolant conduits, pumps, expansion tanks, etc.

Piston 138 may be coupled to crankshaft 140 so that reciprocating motion of the piston is translated into rotational motion of the crankshaft. Crankshaft 140 may be coupled to at least one drive wheel 55 of the passenger vehicle via a transmission system. Further, a starter motor (not shown) may be coupled to crankshaft 140 via a flywheel to enable a starting operation of engine 10.

Cylinder 14 may receive intake air via a series of intake passages 142, 144, and 146. Intake passage 146 may communicate with other cylinders of engine 10 in addition to cylinder 14. FIG. 1 shows engine 10 configured with a turbocharger 175 including a compressor 174 arranged between intake passages 142 and 144, and an exhaust turbine 176 arranged along the exhaust system between an exhaust manifold 148 and an exhaust pipe 158. Compressor 174 may be mechanically coupled to turbine 176 by a shaft 180. A speed of compressor 174 may be regulated by a wastegate 181, arranged in an exhaust system of the engine system 7. In some examples, turbocharger 175 may be an electric turbocharger and at least partially powered by an electric motor.

A charge air cooler (CAC) 160 may be positioned in intake passage 142 downstream of compressor 174 and upstream of a throttle 162. The CAC 160 may be an air-to-air CAC or a liquid-cooled CAC, configured to cool and increase a density of air compressed by the compressor 174. The cooled air may be delivered to the engine 10 and combusted at cylinder 14. It will be understood, that the turbocharger 175 and the CAC 160 may be omitted from the engine 10, in other embodiments.

Throttle 162, including a throttle plate 164, may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Each cylinder of engine 10 may include one or more intake valves and one or more exhaust valves. For example, cylinder 14 is shown including at least one intake valve 150 (e.g., intake poppet valve) and at least one exhaust valve 156 (e.g., exhaust poppet valve) located at an upper region of cylinder 14. In some examples, each cylinder of engine 10, including cylinder 14, may include at least two intake valves and at least two exhaust valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type, cam actuation type, or a combination thereof. The intake and exhaust valve timing may be controlled using variable intake cam timing, variable exhaust cam timing, dual independent variable cam timing, fixed cam timing, concurrent intake/exhaust valve cam timing, etc. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation.

For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes.

However, in some embodiments, spark plug 192 may be omitted, such as where engine 10 may initiate combustion by auto-ignition or by injection of fuel, as may be the case with some diesel engines.

In some examples, each cylinder of engine 10 may be configured with one or more fuel injectors for providing fuel thereto. As a non-limiting example, cylinder 14 is shown including two fuel injectors 166 and 170 in a fuel system 8. Fuel injectors 166 and 170 may be configured to deliver fuel received from fuel system 8. Fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high-pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port fuel injection (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Operation of intake valve 150 is now described in greater detail. The intake valve 150 may be moved from a fully open position to a fully closed position, or to any position there-between. Assuming all other conditions and parameters are constant (e.g., for a given throttle position, vehicle speed, manifold pressure, etc.), the fully open position of the valve allows more air from the intake passage 146 to enter the cylinder 14 than any other position of the intake valve 150. Conversely, the fully closed position may prevent airflow (or allow the least amount of air) from the intake passage 146 into the cylinder 14 relative to any other position of the intake valve 150. Thus, the positions between the fully open and fully closed position may allow varying amounts of air to flow between the intake passage 146 to the cylinder 14. In one example, moving the intake valve 150 to a more open position allows more air to flow from the intake passage 146 to the cylinder 14 than its initial position. It will be understood that the exhaust valve 156 may function in a similar manner to intake valve 150.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations, etc. Moreover, depending on the distribution ratio of injected fuel among injectors 170 and 166, different effects may be achieved.

Fuel tanks in the fuel system 8 hold fuels of different fuel types, such as fuels with different fuel qualities and different fuel compositions. The differences may include different alcohol content, different water content, different octane, different heats of vaporization, different fuel blends, and/or combinations thereof etc. Suitable fuels include gasoline, diesel, biodiesel, alcohol (e.g., methanol, ethanol, etc.), combinations thereof, etc.

As the mixture of intake air and fuel is combusted at cylinder 14, exhaust valve 156 may be commanded to open and flow exhaust gas from cylinder 14 to exhaust manifold 148. The opening of the exhaust valve 156 may be timed to open before intake valve 150 is fully closed so that there is a period of overlap when both valves are at least partially open. The overlap may generate a weak vacuum that accelerates the air-fuel mixture into the cylinder, e.g., exhaust scavenging. The period of valve overlap may be timed in response to engine speed, camshaft valve timing, and based on the configuration of the exhaust system. Exhaust manifold 148 can receive exhaust gases from other cylinders of engine 10 in addition to cylinder 14. The exhaust gas channeled from cylinder 14 to exhaust manifold 148 may flow to turbine 176 or bypass turbine 176 via bypass passage 179 and wastegate 181.

Exhaust gas that is directed to turbine 176 may drive the rotation of turbine 176 when wastegate 181 is closed, thereby spinning compressor 174. Alternatively, when wastegate 181 is at least partially open, e.g., adjusted to a position between fully closed and fully open, or fully open, a portion of the exhaust gas may be diverted around turbine 176 through bypass passage 179. Flowing exhaust flow through bypass passage 179 may decrease the rotation of turbine 176, thereby reducing the amount of boost provided to intake air in intake passage 142 by compressor 174. Thus during events where a rapid decrease in boost is desired, e.g., a tip-out at input device 132, turbine 176 may be decelerated by opening wastegate 181 and reducing the amount of exhaust gas directed to turbine 176.

Wastegate 181 is disposed in bypass passage 179 which couples exhaust manifold 148, downstream exhaust gas sensor 128, to an exhaust pipe 158, between turbine 176 and emission control device 178. Spent exhaust gas from turbine 176 and exhaust gas routed through bypass passage 179 may convene in exhaust pipe 158 upstream of emission control device 178 before catalytic treatment at emission control device 178.

Exhaust gas sensor 128 is shown coupled to exhaust manifold 148 upstream of turbine 176 and a junction between bypass passage 179 and exhaust manifold 148. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example, before treatment at emission control device 178. Emission control device 178 may be a three-way catalyst (TWC), NOx trap, various other emission control devices, or combinations thereof, configured to remove undesirable chemicals from the exhaust gas prior to atmospheric release.

The valves described above and other actuatable components of vehicle 5 may be controlled by controller 12 included in a control system. Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from the various sensors coupled to engine 10 depicted at FIG. 1. In addition to those signals previously discussed, the controller may receive signals including measurement of inducted mass air flow (MAF) from mass air flow sensor 122; engine coolant temperature (ECT) from temperature sensor 116 coupled to water jacket 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Exhaust manifold pressure may be measured by a pressure sensor 182 and pressure in the exhaust pipe 158 measured by another pressure sensor 184. Controller 12 may infer an engine temperature based on an engine coolant temperature. Input from a vehicle operator 130 via an input device 132 may be used to adjust engine output. In this example, input device 132 includes an accelerator pedal and a pedal position sensor 134 for generating a proportional pedal position signal PP.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

In some examples, vehicle 5 may be a hybrid vehicle with multiple sources of torque available to one or more vehicle wheels 55. In other examples, vehicle 5 is a conventional vehicle with only an engine. In FIG. 1, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from an energy storage device 58 (e.g., battery, flywheel, superconductor, etc.) to provide torque to vehicle wheels 55. Electric machine 52 may also be operated as a generator to provide electrical power to charge energy storage device 58, for example during a braking operation.

The controller 12 receives signals from the various sensors of FIG. 1 and employs the various actuators of FIG. 1 to adjust engine operation based on the received signals and instructions stored on a memory of the controller. For example, the controller may use a temperature measured by the temperature sensor 116 at water jacket 118 to adjust a flow rate of coolant through the water jacket. If the temperature is detected to increase above a threshold temperature, the controller 12 may command the coolant pump 72 to increase a pumping speed to pump coolant through the water jacket at a faster rate, thereby increasing heat extraction by the coolant. As another example, the temperature measured at the water jacket 118 by the temperature sensor 116 may be used to infer a temperature in the cylinder 14. It will be appreciated that the engine cooling system may be adjusted based on engine temperature, speed, ambient temperature, etc. Spark timing may be advanced based on the estimated cylinder temperature to achieve increased power output during vehicle operations demanding increased torque.

Thermal management at a cylinder block may reduce a temperature of the cylinder block during combustion events. Consequently, engine fuel economy may be increased and engine emissions may be reduced.

FIG. 2 shows an example of an engine 200 including an engine block 202. The engine 200, and the corresponding components, shown in FIG. 2 are examples of the engine 10 and corresponding components, illustrated in FIG. 1. Therefore, the features from the engine 200 in FIG. 2 may be included in the engine 10 shown in FIG. 1 and vice versa.

The engine block 202 includes a cylinder block 204 with a water jacket 206. The water jacket 206 receives coolant from an inlet 208 in the water jacket. It will be understood that the inlet 208 may receive coolant from upstream cooling system components such as a pump, heat exchanger, etc. For instance, a coolant conduit may extend between the pump and the inlet 208.

The water jacket 206 may be included in an engine system 210 (e.g., engine cooling system). Thus, the engine system 210 shown in FIG. 2 is an example of the engine cooling system 70, shown in FIG. 1. The engine system 210 includes the engine block 202 having the cylinder block 204, water jacket 206, and water jacket diverter 212.

The engine system 210 in FIG. 2 includes three cylinder block bores in an inline configuration. An inline cylinder configuration is defined herein as a consecutive arrangement of cylinders whose central axes 214 are aligned along a longitudinal axis 216. However, numerous suitable type of cylinder arrangements have been envisioned, such as v-type configurations, horizontally opposed configurations, etc. As described herein, an axial direction refers to a direction parallel to the central axes and radial refers to a direction extending outward from one of the central axes and perpendicular thereto.

The cylinder block 204 includes lateral sides 218 and longitudinal sides 220 (e.g., a front side 222 and a rear side 224. A front-end drive assembly may be coupled to the front side of the block and a flywheel or other suitable transmission component may be coupled to the rear side of the block.

The water jacket inlet 208 opens into an interior region 226 of the water jacket 206, through which coolant flows during cooling system operation. Arrows 228 indicate a general coolant flow direction from the inlet 208 into the water jacket 206. However, it will be understood that the coolant flow has additional complexity that is not captured by the arrows.

A boundary of the interior region 226 may be at least partially delineated via a first wall 230 and a second wall 232 of the cylinder block 204. The water jacket diverter 212 is positioned within the interior region 226 between the first wall 230 and the second wall 232.

The water jacket diverter 212 is designed to generate a coolant flow pattern in the water jacket that decreases temperature gradients in the coolant flowing there through and the cylinder block, correspondingly. The water jacket diverter 212 may include at least a masking wall and a tuning ledge to provide the aforementioned coolant flow balancing functionality. However, additional features such as comb structures, fins, etc., may be included in the diverter, in some examples. The flow balancing features of the water jacket diverter 212 are described in greater detail herein with regard to FIGS. 3-7.

The interior region 226 of the water jacket 206 at least partially circumferentially surrounds cylinder block bores 234. It will be appreciated, that when the cylinder block 204 is attached to a cylinder head the bores 234 may form a portion of the engine cylinders. The cylinder block bores 234 include central axes 214.

The cylinder block 204 may be constructed out of a metal such as aluminum, magnesium, iron (e.g., steel), etc. The water jacket diverter 212 may be constructed out of a different material than the cylinder block 204, in one example. For instance, the diverter may be constructed at least partially out of a polymeric material and the cylinder block may be constructed out of metal.

However, in other examples, the diverter and cylinder block may share a common material construction.

Each piston and corresponding cylinder may be conceptually divided into sides with regard to piston thrust. In one particular characterization, a side of the piston and cylinder experiencing greater piston thrust may be referred to as a major piston thrust side of the cylinder. On the other hand, the opposite side of the piston and cylinder may be referred to as a minor thrust side. Piston thrust may be defined as side force exerted on the piston due crankshaft and piston rod kinematics. Thus, the piston thrust directions may be perpendicular to the central axis of the piston. A plane extending into and out of the page aligned with the longitudinal axis 216 may divide the piston and the cylinder block bores into the major thrust side 236 and the minor thrust side 238, is shown in FIG. 2. It will be appreciated that other components in the engine block such as the water jacket, diverter, etc., may also be conceptually divided into a major and a minor thrust side along the longitudinal axis 216.

The diverter may be constructed via injection molding. For instance, plastic or resin may be injected into a mold. Injection molding may expose the material to high pressure during formation of the diverter, resulting in a product with a high density. Thus, the diverter may be injection molded as a single, continuous unit, with enhanced strength and durability of the diverter. A weight of the plastic diverter may be reduced relative to a diverter of similar dimensions but formed from metal. It will be appreciated that the diverter may also be formed by alternate methods such as die casting and poured plastic casting. The cylinder block 204 includes bore bridge sections 240 positioned between the cylinder block bores 234. It will be appreciated that the engine may be formed by attaching a cylinder head to the cylinder block 204 via attachment apparatuses, gaskets, etc., for example.

Reference axes 250 are provided in FIG. 2 as well as FIGS. 3-11, to establish a common frame of reference in the figures. The z-axis may in one example, be parallel to a gravitational axis. Additionally or alternatively, the x-axis may be a lateral axis and the y-axis may be a longitudinal axis, in one example. However, other orientations of the axes have been envisioned. In one example, cylinder block bores 234 may be included in one cylinder bank. In such an example, a second set of cylinder block bores may be included in a second cylinder bank. The second cylinder bank may include an associated water jacket and water jacket diverter. The cylinder banks may be arranged in a v-type configuration, in some instances. However, numerous suitable cylinder arrangements have been contemplated.

Figure 3:
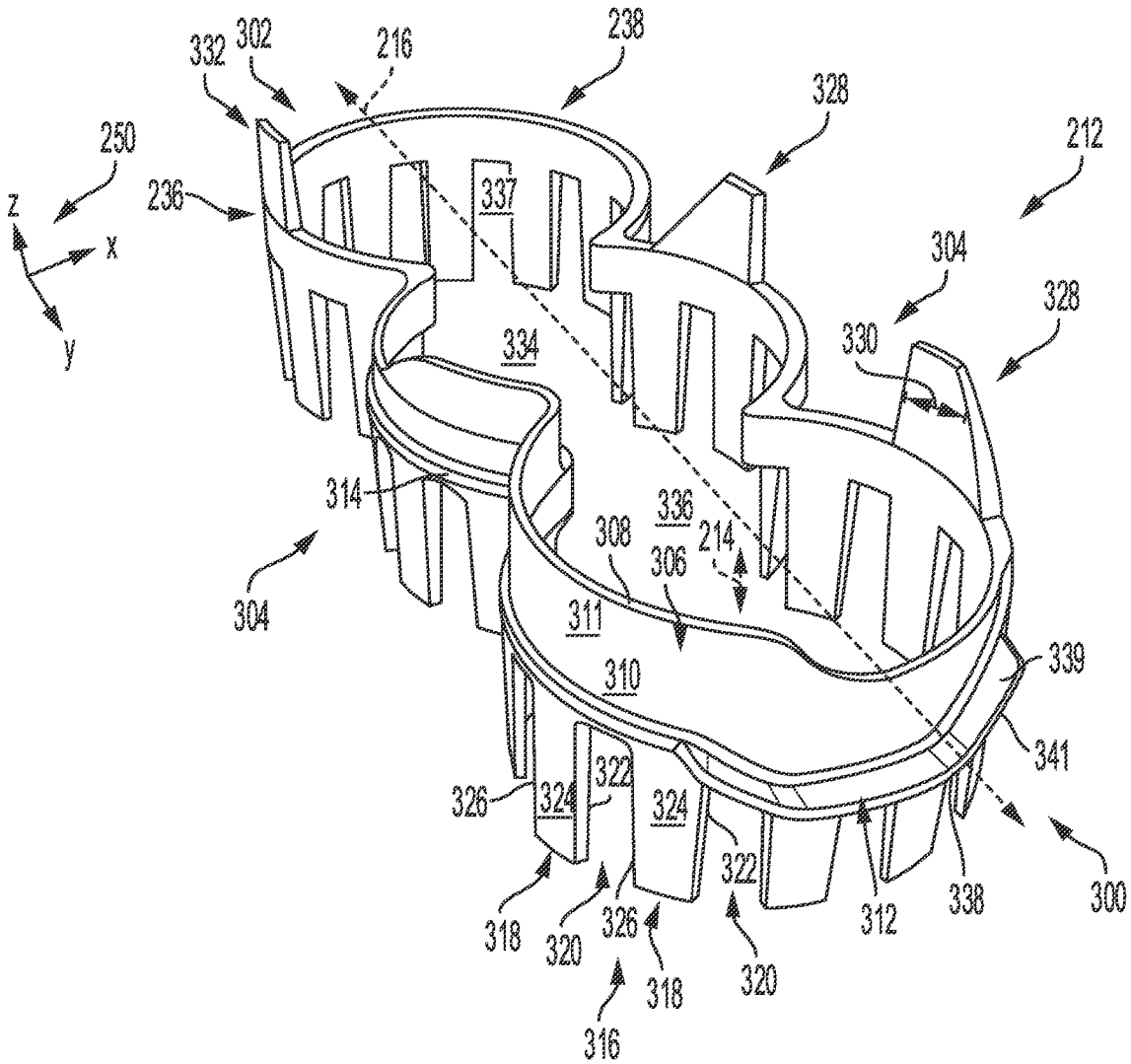
FIG. 3 shows a perspective view of the water jacket diverter, shown in FIG. 2.

FIG. 3 shows a detailed view of the water jacket diverter 212, shown in FIG. 2. The water jacket diverter 212 includes a front side 300, a rear side 302, and lateral sides 304. As previously discussed, the water jacket diverter 212 is contoured to fit within the water jacket 206, shown in FIG. 2. Thus, the water jacket diverter at least partially surrounds the cylinder block bores. The cylinder block bores may be parsed into a middle (e.g., central) cylinder block bore 334 and two peripheral cylinder block bores 336 and 337. Additionally, the water jacket diverter 212 is also shown as a unitary piece. That is to say that the water jacket forms a continuous uninterrupted shaped. However, in other examples, the water jacket diverter may include two or more discrete sections spaced away from each other.

The water jacket diverter 212 includes a masking wall 306. The masking wall 306 has a reduced thickness when compared to a thickness of the rail 314. The thickness of the masking wall 306 is indicated at 602 and the thickness of the rails 314 is indicated at 606, in FIG. 6. Continuing with FIG. 3, in the illustrated example, the masking wall 306 is positioned on the front side 300 of the diverter and also extends down a portion of one of the lateral sides 304 of the diverter. However, other masking wall locations have been envisioned. The masking wall 306 is designed to decrease coolant flow velocities in targeted locations (e.g., on the major piston thrust side of the block) in the water jacket to balance coolant flow and provide more balanced cooling to the cylinder block. Specifically, in the illustrated example, the masking wall restricts coolant flow near the major piston trust side of the water jacket. The major thrust side 236 and the minor thrust side 238 of the water jacket are indicated in FIG. 3 along with the longitudinal axis 216 delineating the plane forming the boundary between the major and minor thrust sides. As a result, thermal deformation caused by cooling imbalances is reduced. The likelihood of unwanted engine behaviors, such as piston scuff, may be reduced due to the decrease of thermal deformation of the cylinder block. As a result, engine longevity and durability are increased. In one example, the water jacket diverter 212 may allow the engine to maintain a desired piston to bore clearance such as clearance of at least 0.050 mm.

It will be appreciated that coolant flow from the outlet 208, shown in FIG. 2, impinges upon the masking wall 306. Specifically, in one example, the masking walls vertically extends above a top of the outlet with regard to an axis parallel to the z-axis. However, other masking wall contours may be used, in other embodiments. The masking walls 306 and other features of the water jacket diverter 212 generally have a curvature that conforms to a shape of the cylinder bores, in the illustrated example. However, other diverter contours have been contemplated.

The masking wall 306 includes an upper surface 308 and a tuning section 310 having a reduced thickness. The tuning section 310 is essentially a local reduction in thickness of the masking wall in a location where coolant flow is restricted. The tuning section 310 is shown positioned below an upper section 311 of the masking wall. Furthermore, the tuning section is spaced away from the upper surface 308, in the illustrated example. However, in other examples, the tuning section 310 may be positioned adjacent to or extend along the upper surface 308. The tuning section 310 works in conjunction with the masking wall 306 to provide desirable coolant flow characteristics. For instance, the flow restriction of the masking wall may be reduced (e.g., counteracted) by using the tuning section 310. In this way, granular sections of the diverter can be tuned to achieve desired flow diverting characteristics. Specifically, in one example, the masking wall may be added in a location that does not restrict overall coolant flow, which could be accomplished by having reduced masking wall thickness relative to the rail thickness.

However, it will be appreciated that in some examples the masking wall may partially restrict overall coolant flow in the water jacket.

The water jacket diverter 212 further includes a tuning ledge 312 positioned adjacent to the masking wall 306. The tuning ledge 312 extends outward from the masking wall 306 with regard to the axis 214. However, in other examples, the tuning ledge 312 may be spaced away from the masking wall 306. The tuning ledge 312 is designed to direct coolant to desired locations in the water jacket. For instance, the tuning ledge 312 may reduce the amount of coolant flowing to lower sections of the water jacket while also directing coolant away from the major piston thrust sides of the pistons. The tuning ledge 312 may work in conjunction with the masking wall 306 to generate a desirable coolant flow pattern in the water jacket during cooling system operation.

A rail 314 also extends around the water jacket diverter 212. The rail 314 has a greater thickness than the thickness of the masking wall 306, in the illustrated example. However, in other instances, the thickness of the rail may be equal to or less than the thickness of the masking wall.

The water jacket diverter 212 also includes a comb structure 316, in FIG. 3. However, in other examples, the comb structure may be omitted from the diverter. The comb structure 316 includes extensions 318 and cut-outs 320 positioned between the extensions. The extensions 318 and cut-outs 320 project downward from the rail 314. In the depicted example, the extensions 318 tapper in a downward direction. In other words, the thickness of the extensions decreases in a downward direction. Additionally, each of the extensions 318 have a similar geometric profile, in FIG. 3. However, in other examples, the geometric profiles of the extensions may vary from extension to extension and/or at least some of the extensions may include a non-tapered profile.

The extensions 318 each include an interior face 322 and an exterior face 324 along with sidewalls 326. The interior and exterior faces of the extensions have a greater width than the sidewalls. In this way, the extensions 318 are shaped as prongs. However, other extension shapes may be used. The extensions are also equally spaced around the periphery of the diverter, in the illustrated example. However, in other examples the spacing between the comb structure's extensions may vary.

The illustrated water jacket diverter 212 further includes fins 328 extending upwards from the rail 314. The fins 328 taper in thickness and in width, indicated at 330, in an upward direction. However, other fin contours with non-tapered thicknesses and/or widths, have been envisioned. Two of the fins 328 are positioned on the minor thrust side of the water jacket diverter 212, in the illustrated example. Fin 332 is positioned on the major thrust side of the water jacket diverter 212 and offset from the fin on the minor thrust side with regard to the longitudinal axis. The fins may be used to control coolant flow distribution side to side, with regard to the longitudinal axis and increase coolant velocity depending on the size and taper.

The masking wall 306 shown in FIG. 3, extends partially around the peripheral cylinder block bore 336 and partially around the middle cylinder block bore 334 on the major piston thrust side. In this way, coolant flow velocities on the piston thrust side of the middle bore are reduced, to again allow a more balanced coolant flow to be achieved. However, other water jacket diverter designs may include a masking wall extending around a portion of the peripheral cylinder block bore 336 and is not adjacent to the middle cylinder block bore 334.

In other examples, the water jacket diverter 212 may include one or more additional masking wall(s) with reduced thickness tuning section(s) positioned adjacent to other cylinder block bores such as the middle cylinder block bore or the other peripheral cylinder block bore. In such an example, the additional masking wall(s) may be positioned on the major piston thrust side of the diverter. In this way, additional coolant may be directed away from the major thrust side of the cylinder block, if desired.

The tuning ledge 312 is shown including a sidewall 338, a top surface 339, and a bottom surface 341. In one example, the sidewall 338 of the tuning ledge 312 may be shaped to increase flow restriction in the water jacket. For instance, the vertical thickness of the sidewall 338 may be tuned to achieve desired flow characteristics. For instance, the inlet ledge can be used to restrict flow from going to the bottom of the water jacket. Furthermore, the smoother shape reduces the pressure loss.

It has been found through the extensive use of computer aided engineering (CAE) analysis and empirical testing (e.g., a dynamometer thermocycle test (PTC)) of the water jacket diverter 212, shown in FIG. 3, in a water jacket of an engine that piston scuff is reduced when compared to previous diverters experiencing elevated piston scuff. Specifically, in certain PTC tests an engine using the water jacket diverter did not exhibit observable piston scuff when compared to previous flow diverter designs without the masking wall and the tuning ledge exhibiting observable piston scuff in PTC tests.

Figure 4:
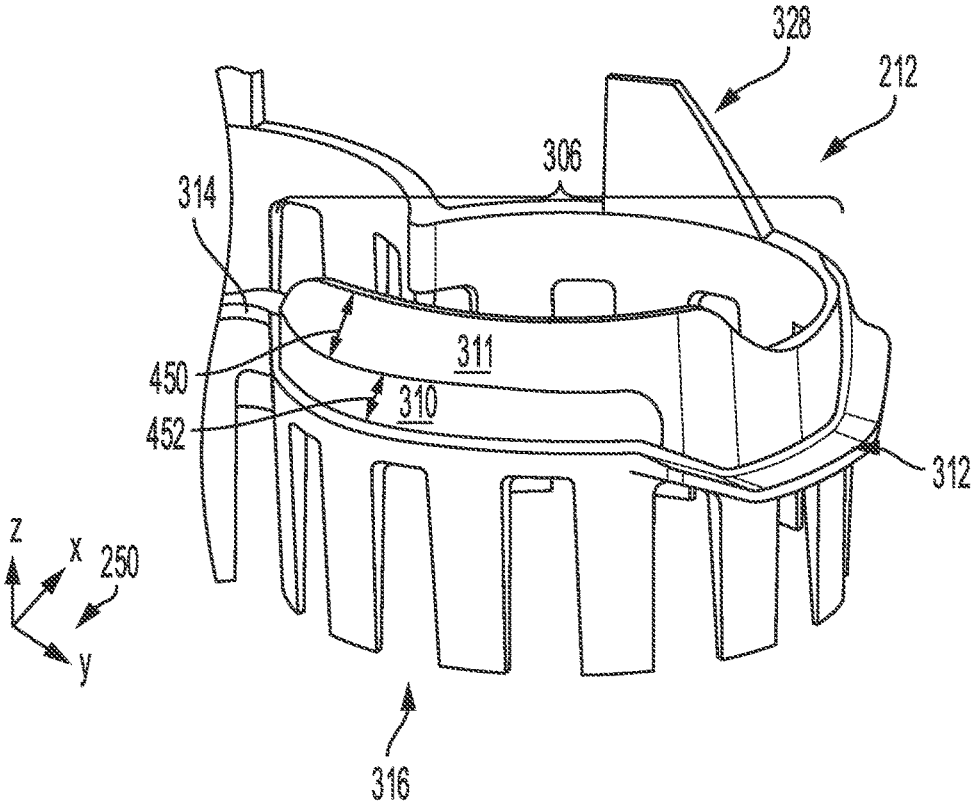
FIGS. 4-7 show different views of the water jacket diverter, illustrated in FIG. 3.

FIG. 4 shows a detailed view of a portion of the water jacket diverter 212, depicted in FIG. 3. Again, the masking wall 306, tuning ledge 312, fins 328, and comb structure 316 are shown.

The tuning ledge 312 is shown radially extending from the rail 314. Thus, the radial thickness of the tuning ledge 312 exceeds the radial thickness of the rail. In this way, the ledge serves to tune coolant flow. The tuning section 310 and the upper section 311 of the masking wall 306, are also shown in FIG. 4. The tuning section 310 has thickness that is less than the upper section 311 of the masking wall 306 to allow for coolant flow restriction around the masking wall to be partially counteracted to achieve a balanced coolant flow pattern in the water jacket. The tuning section 310 is shown extending to the rail 314 on one side and to the tuning ledge 312 on the opposing side. The thickness, vertical height, and/or length of the tuning section may be selected based on desired end-use flow characteristics. Moreover, the geometric profiles of the tuning section may correlated to the geometric profile of the remainder of the masking wall 306, in some examples. For instance, in the depicted example, the height 450 of the upper section 311 of the masking wall is less than the height 452 of the tuning section 310. As shown, the height is measured along an axis parallel to the z-axis. Increasing the surface area of the tuning section 310 and reducing the thickness of the tuning section allow flow restriction of the masking wall to be moderated to allow desired localized flow rate to be achieved. Tuning the ratio height of the masking wall to tuning section can be done to improve coolant flow, velocity and pressure drop. Additionally, the mask shields local cylinder bore wall locations to reduce the likelihood (e.g., prevent) over-cooling and bore distortion.

Figure 5:
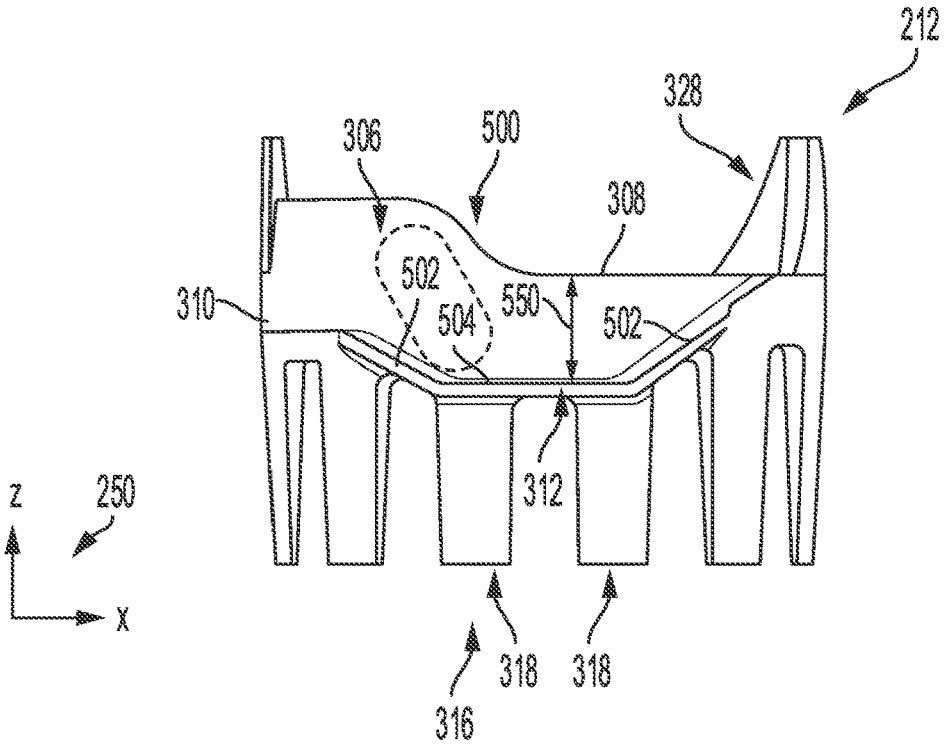

FIG. 5 shows a front view of the water jacket diverter 212, shown in FIG. 3. Again, the masking wall 306 with the tuning section 310, the tuning ledge 312, the fins 328, and the comb structure 316 are illustrated.

The masking wall 306 is shown vertically extending from the tuning ledge 312.

Additionally, the masking wall 306 varies in height, in the illustrated embodiment. To elaborate, the masking wall 306 increases in height above the tuning section 310 and decreases in height above the tuning ledge 312. Varying the masking wall height in this way allows a portion of the coolant to be directed away from the major piston thrust side of the diverter to balance cooling in the water jacket. Specifically, the upper surface 308 of the masking wall 306 is shown varying in height 550. In the illustrated example, the upper surface 308 includes an angled section 500 decreasing in height above the tuning ledge 312. The angled section 500 may form a non-straight angle with regard to the lateral axis. However, other masking wall contours may be used, in other embodiments. For instance, the masking wall height may decrease in a location closer to the major thrust side of the piston.

The extensions 318 of the comb structure 316 are shown projecting downward from the tuning ledge 312. However, in other examples, the extensions extending from the tuning ledge may be omitted, in other embodiments.

The tuning ledge 312 is shown including angled sections 502 and a lower section 504. As shown, the lower section 504. The junctions between the angled sections 502 and the lower section 504 is curved, in the illustrated example. However, other geometric profiles of the ledge may be utilized, in other examples.

Figure 6:
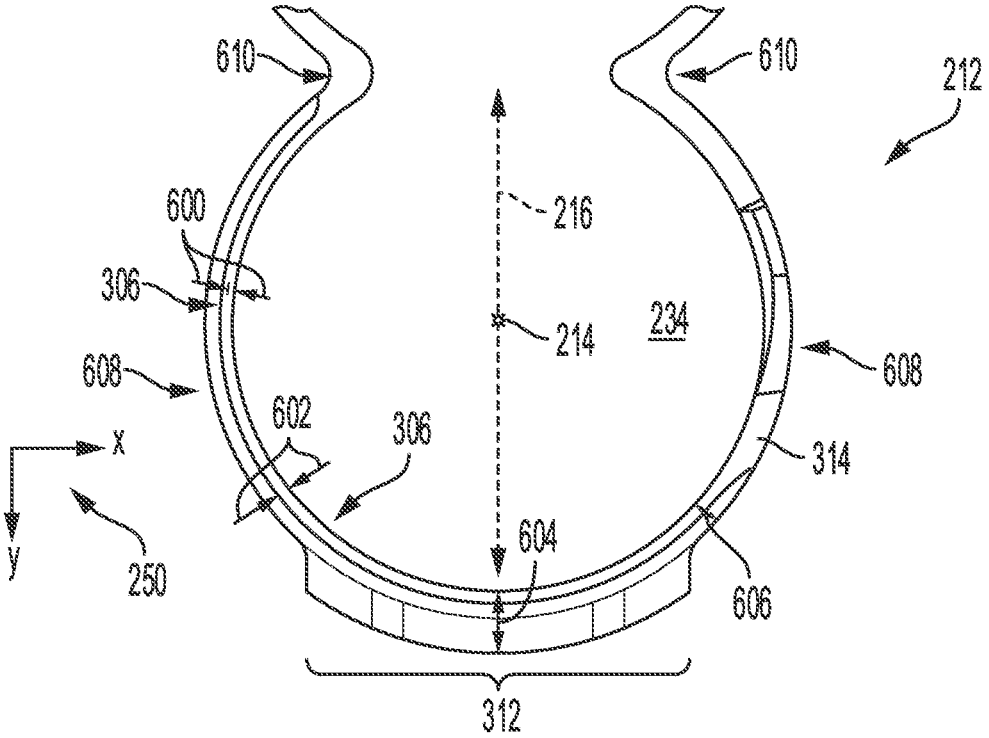

FIG. 6 shows a top view of a portion of the water jacket diverter 212, illustrated in FIG. 3. The tuning ledge 312 and the masking wall 306 with the tuning section 310 of the diverter are again shown. The tuning ledge 312 is shown symmetrically arranged about the longitudinal axis 216. However, in other examples, the tuning ledge may be offset with regard to the longitudinal axis. For instance, the tuning ledge may be positioned on the major thrust sided or the minor thrust side of the diverter. In other examples, the tuning ledge may be adjacent to another one of the cylinder block bores. Additionally, one of the fins in the diverter is also depicted in FIG. 6.

The radial thickness 600 of the tuning section 310 of the masking wall 306 less than the radial thickness 602 of the masking wall 306 at other locations. The thicknesses are measured from the central axis 214 along a radial axis. In this way, the flow restriction caused by the masking wall may be tempered to allow a desired coolant flow velocity to be achieved around the masking wall.

FIG. 6 also shows a radial thickness 604 of the tuning ledge 312 being greater than a radial thickness 606 of the rail 314. In this way, the tuning ledge 312 directs a greater amount of flow away from lower portions of the water jacket to again achieve more balanced cooling. The rail 314 has a substantially equivalent thickness in regions 608 surrounding the bore 234. However, in bridge regions 610 the radial thickness of the rail 314 is greater than the regions 608. However, other rail profiles can be used.

Figure 7:
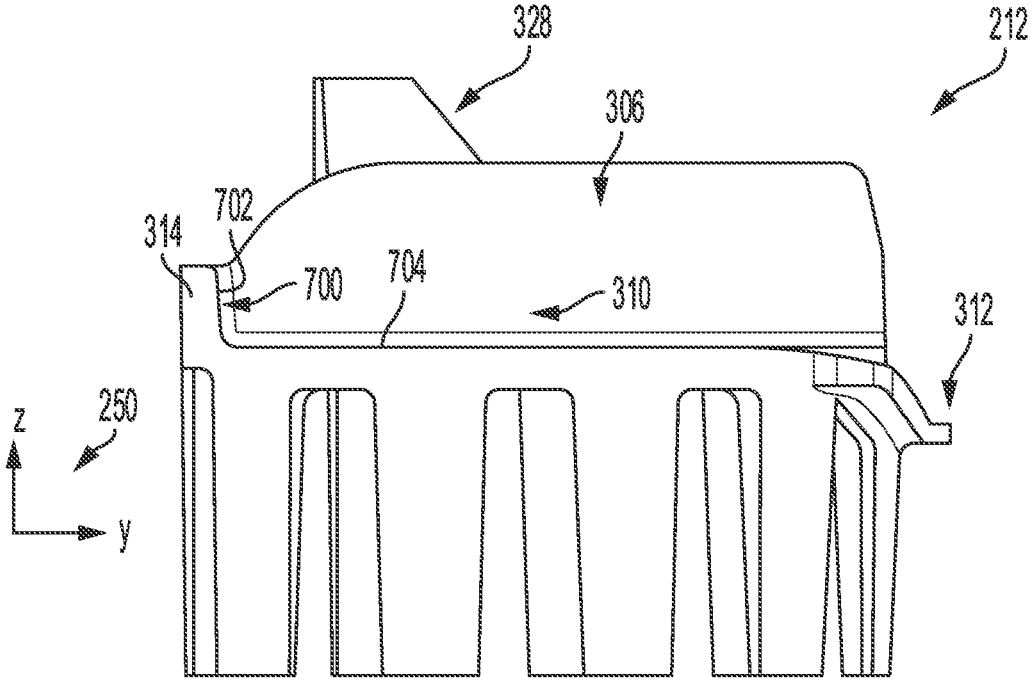

FIG. 7 shows a side view of a portion of the water jacket diverter 212, depicted in FIG. 3. The masking wall 306, tuning ledge 312, along with one of the fins 328 are illustrated in FIG. 7. The tuning section 310 of the masking wall 306 having a reduced thickness is again depicted. The intersection 700 between the rail 314 and the masking wall 306 is also depicted in FIG. 7. To elaborate, the intersection 700 includes a side section 702 and a lower section 704.

FIG. 8 shows another example of a water jacket diverter 800. It will be appreciated that water jacket diverters combining features, structural characteristics, etc., of the different examples of the water jacket diverters have been envisioned. That is to say that the water jacket diverter 800 may include features, structures, etc., from the water jacket diverter 212, shown in FIGS. 2-7, or vice versa. The water jacket diverter 800 includes a masking wall 802, a rail 804, and a comb structure 806. The masking wall 802 does not extend vertically above the rail 804. Rather, the masking wall 802 extends downward. Furthermore, the extensions 808 in the comb structure 806 do not extend below the masking wall. The water jacket diverter again includes a fin 810 extending from the rail 804. The design in FIG. 8 has a lower coolant inlet location when compared to the design shown in FIG. 4. The coolant inlet location may dictate the size and location of the masking wall, in one example. An example of a water jacket inlet position is indicated at 850. Thus, the water jacket inlet may be radially aligned with at least a portion of the masking wall. For instance, a central axis of the inlet may extend through the masking wall. However, other positions between the masking wall and the inlet of the water jacket have been contemplated. Furthermore, the masking wall 802 and the inlet 850 in the embodiment shown in FIG. 8 may be positioned on the thrust side of the cylinder block.

FIG. 9 shows yet another example of a water jacket diverter 900. The water jacket diverter 900 includes several of the structural features of the water jacket diverter 212, shown in FIG. 3. Redundant description is therefore omitted for brevity. The water jacket diverter 900 includes a cut-out 902 in a rail 904. The cut-out 902 has a reduced thickness when compared to other sections of the rail 904 and vertically extends through the rail 904. The thickness is measured along a radial direction corresponding to a central axis of one of the cylinder bores. The cut-out 902 allows coolant flow adjacent to bridges between the cylinder block bores to be increased, to reduce the likelihood of imbalanced block cooling. The water jacket diverter 900 shown in FIG. 9 also includes a masking wall 906 and a tuning ledge 908. The cut-out 902 is spaced away from the masking wall 906, in the illustrated example. However, in other examples, the cut-out 902 may be positioned in the masking wall 906 and/or have other suitable orientations.

FIG. 10 shows another example of a water jacket diverter 1000. The water jacket diverter 1000 includes a cut-out 1002 in a rail 1004. The cut-out 1002 again has a reduced thickness as measured along a radial direction corresponding to a central axis of one of the cylinder bores. The cut-out 1002 may be positioned next to a bridge location adjacent to a peripheral cylinder bore 1006 and a middle cylinder block bore 1008 in a cylinder block. The cut-out 1002 allows coolant flow velocities to be reduced in the depression formed via the cut-out. The water jacket diverter 1000 again includes a masking wall 1010 and a tuning ledge 1012. The masking wall 1010 extends around the piston thrust side of the diverter to a location adjacent to the middle cylinder block bore 1008. However, numerous masking wall profiles have been envisioned.

FIG. 11 shows another example of a water jacket diverter 1100. The water jacket diverter 1100 includes a cut-out 1102 in a rail 1104 adjacent to a masking wall 1106. The cut-out 1102 allows coolant flow velocities near the cylinder bridges to be increased to again provide more balanced cylinder block cooling. The cut out pushes the coolant above the rail. The reduced rail thickness at the cut-out 1102 reduces coolant restriction to counteract restriction added by the masking wall 1106.

FIGS. 2-11 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

FIG. 12 shows a method 1200 for operating an engine cooling system. The method 1200 may be implemented a controller with instructions stored in non-transitory memory executable by a processor that cause the processor to implement the method steps. Furthermore, the method 1200 may be implemented via the engine cooling system and corresponding components discussed above with regard to FIGS. 1-11. However, in other examples, the method 1200 may be implemented via other suitable engine cooling systems.

At 1202 the method includes flowing coolant from a coolant pump to the cylinder block water jacket inlet. In this way, coolant may be circulated through a loop that may include a heat exchanger (e.g., radiator), pump, conduits, etc., to facilitate coolant transport through the engine block to remove heat from the block.

Next at 1204 the method includes flowing coolant from a cylinder block water jacket inlet into a cylinder block water jacket at least partially surrounding a cylinder block bore. As previously discussed, the water jacket may at least partially surround one or more cylinder block bores experiencing elevated levels of heat during combustion operation. Therefore, the water jacket diverter passively augments coolant flow in the water jacket to achieve a desired flow pattern.

At 1206 the method includes adjusting coolant flow in a cylinder block water jacket with a water jacket diverter positioned in the cylinder block water jacket to decrease temperature gradients in the cylinder block. In one example, adjusting the coolant flow in the water jacket includes decreasing a velocity of the coolant flow on the major piston thrust side of the cylinder block bore. In this way, temperature gradients in the water jacket and cylinder block can be correspondingly reduced, to diminish the chance piston scuff or other unwanted consequences of cylinder block thermal deformation.

At 1208 the method includes flowing coolant from the cylinder block water jacket to downstream cooling system components. For instance, coolant may be flowed from the cylinder block water jacket to a cylinder head water jacket, in one example. For instance, crossover conduits may be provided between the water jackets. However, in another example, coolant may be flowed from the cylinder block water jacket to heat exchanger, such as a radiator. It will be appreciated that numerous suitable cooling system configurations have been envisioned.

Method 1200 allows coolant flow in the cylinder block water jacket to be tuned to decrease temperature hot spots in the cylinder block. In other words, the cylinder block is more evenly cooled to reduce the likelihood of unwanted thermal distortions in the block. As a result, the chance of unwanted engine behaviors like piston scuff may be reduced, thereby increasing engine longevity and durability.

The technical effect of providing a water jacket diverter in a water jacket with a masking wall and a tuning ledge is to reduce cylinder block temperature gradients caused by imbalanced coolant flow. As a result, cylinder block durability is increased.

The invention will be further described in the following paragraphs. In one aspect, a water jacket diverter for a cylinder block is provided that comprises a masking wall arranged above a rail and including a tuning section having a reduced thickness; and a tuning ledge adjacent to the masking wall and extending outward from the masking wall with regard to a cylinder bore axis.

In another aspect, a method for operating an engine cooling system is provided that comprises flowing coolant from a cylinder block water jacket inlet into a cylinder block water jacket at least partially surrounding a cylinder block bore; and adjusting coolant flow in the cylinder block water jacket using a water jacket diverter positioned in the cylinder block water jacket to decrease temperature gradients in the cylinder block; where the water jacket diverter includes: a masking wall arranged above a rail adjacent to the cylinder block water jacket inlet and including a tuning section having a reduced thickness; and a tuning ledge adjacent to the masking wall and extending outward from the masking wall with regard to a cylinder bore axis. In one example, the method may further comprise flowing coolant to the cylinder block water jacket inlet from a coolant pump.

In another aspect, an engine block is provided that comprises: a cylinder block with a plurality of cylinder bores; a water jacket disposed in the cylinder block, at least partially surrounding the plurality of cylinder bores, and configured to flow coolant around the cylinder bores; and a water jacket diverter positioned in the water jacket, formed as a unitary piece, and arranged around the plurality of cylinder bores; where the water jacket diverter includes: a masking wall arranged above a rail adjacent to the cylinder block water jacket inlet; and a tuning ledge adjacent to the masking wall and extending outward from the masking wall with regard to a cylinder bore axis.

In any of the aspects or combinations of the aspects, adjusting the coolant flow in the cylinder block water jacket may include decreasing a velocity of the coolant flow on a major piston thrust side of the cylinder block bore.

In any of the aspects or combinations of the aspects, the tuning ledge may comprise a section extending downward from the rail and the masking wall may comprise a section extending upward from the tuning ledge.

In any of the aspects or combinations of the aspects, the masking wall may be positioned adjacent to a major piston thrust side of a cylinder wall in the cylinder block.

In any of the aspects or combinations of the aspects, the masking wall may only extend around a periphery of one of the plurality of cylinder bores.

In any of the aspects or combinations of the aspects, the one of the plurality of cylinder bores may be a peripheral bore and where the plurality of cylinder bores may be arranged in an inline configuration.

In any of the aspects or combinations of the aspects, the masking wall may have an upper surface with a varying height.

In any of the aspects or combinations of the aspects, the tuning ledge may curve downward from the rail with regard to a central axis of one of the plurality of cylinder bores.

In any of the aspects or combinations of the aspects, the masking wall may include a tuning section having a reduced thickness.

In any of the aspects or combinations of the aspects, the rail may include a reduced thickness section spaced away from the masking wall.

In any of the aspects or combinations of the aspects, the engine block may further comprise a fin extending upward from the rail and spaced away from the wall and a plurality of cut-outs extending downward from the rail and forming a comb structure, where the comb structure extend around a periphery of the water jacket diverter.

In any of the aspects or combinations of the aspects, a thickness of the masking wall may be less than a thickness of the fin.

In any of the aspects or combinations of the aspects, the engine cooling system including the engine block may be included in a hybrid vehicle.

In another representation, a water jacket diverter is provided that comprises a masking wall adjacent to an inlet of a water jacket and a tuning ledge extending radially outward from the masking wall; where coolant flow from the inlet impinges upon the masking wall to decrease the velocity of coolant flow on a piston thrust side of a cylinder bore.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A water jacket diverter for a cylinder block, comprising:

a masking wall arranged above a rail and including a tuning section having a reduced thickness when compared to a remainder of the masking wall;

a tuning ledge adjacent to the masking wall and extending outward from the masking wall with regard to a cylinder bore axis; and a fin extending upward from the rail and spaced away from the wall and/or a plurality of cut-outs extending downward from the rail and forming a comb structure, where the comb structure extends around a periphery of the water jacket diverter.

2. The water jacket diverter of claim 1, where the masking wall is positioned adjacent to a major piston thrust side of a cylinder wall in the cylinder block.

3. The water jacket diverter of claim 1, where an inlet of a cylinder block water jacket opens into a section of the cylinder block water jacket adjacent to the masking wall.

4. The water jacket diverter of claim 3, where the inlet is positioned on one longitudinal side of a plurality of cylinders in an inline arrangement.

5. A water jacket diverter for a cylinder block, comprising:

a masking wall arranged above a rail and including a tuning section having a reduced thickness when compared to a remainder of the masking wall;

a tuning ledge adjacent to the masking wall and extending outward from the masking wall with regard to a cylinder bore axis, where the masking wall has an upper surface with a varying height, including the masking wall increasing in height above the tuning section and decreasing in height above the tuning ledge.

6. The water jacket diverter of claim 5, where the tuning ledge comprises a section extending downward from the rail and the masking wall comprises a section extending upward from the tuning ledge.

7. The water jacket diverter of claim 5, where the tuning section is positioned below an upper surface of the masking wall.

8. An engine block comprising:

a cylinder block with a plurality of cylinder bores;

a water jacket disposed in the cylinder block, at least partially surrounding the plurality of cylinder bores, and configured to flow coolant around the cylinder bores; and a water jacket diverter positioned in the water jacket, formed as a unitary piece, and arranged around the plurality of cylinder bores;

where the water jacket diverter includes:

a masking wall arranged above a rail adjacent to the cylinder block water jacket inlet, the masking wall including a tuning section having a reduced thickness when compared to a remainder of the masking wall; and a tuning ledge adjacent to the masking wall and extending outward from the masking wall with regard to a cylinder bore axis, where the masking wall has an upper surface with a varying height, including the masking wall increasing in height above the tuning section and decreasing in height above the tuning ledge.

9. The engine block of claim 8, where the masking wall only extends around a periphery of one of the plurality of cylinder bores.

10. The engine block of claim 9, where the one of the plurality of cylinder bores is a peripheral bore and where the plurality of cylinder bores are arranged in an inline configuration.

11. The engine block of claim 8, where the masking wall has an upper surface with a varying height.

12. The engine block of claim 8, where the tuning ledge curves downward from the rail with regard to a central axis of one of the plurality of cylinder bores.

13. The engine block of claim 8, where the water jacket diverter further includes a fin extending upward from the rail and spaced away from the wall and/or a plurality of cut-outs extending downward from the rail and forming a comb structure, where the comb structure extends around a periphery of the water jacket diverter.

14. The engine block of claim 8, where the rail includes a reduced thickness section spaced away from the masking wall.

* * * * *